US008991644B2

(12) United States Patent
Mattox et al.

(10) Patent No.: US 8,991,644 B2
(45) **Date of Patent: *Mar. 31, 2015**

(54) VARIABLE HEIGHT ADJUSTABLE STORAGE CAPACITY CONTAINER

(76) Inventors: David Sean Mattox, Lawrenceville, GA (US); Bartow Thomas, Jr., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/351,201

(22) Filed: Jan. 16, 2012

(65) Prior Publication Data

US 2012/0138607 A1 Jun. 7, 2012

Related U.S. Application Data

(63) Continuation-in-part of application No. 12/401,596, filed on Mar. 10, 2009, now Pat. No. 8,096,443.

(51) Int. Cl.

| | |
|---|---|
| ***B65D 43/12*** | (2006.01) |
| ***B65D 85/00*** | (2006.01) |
| ***B65D 21/08*** | (2006.01) |

(52) U.S. Cl.

CPC ..... *B65D 21/086* (2013.01)
USPC ..... 220/788; 220/796; 220/8

(58) Field of Classification Search

USPC ..... 220/796, 788, 4.24, 4.25, 4.21, 8; 206/507

See application file for complete search history.

(56) References Cited

U.S. PATENT DOCUMENTS

| | | | | |
|---|---|---|---|---|
| 2,454,455 | A | 11/1948 | Irwin | |
| 3,982,651 | A * | 9/1976 | Braun et al. | 220/4.21 |
| 4,765,500 | A * | 8/1988 | Ingram | 220/4.24 |
| 5,388,714 | A | 2/1995 | Zutler | |
| 6,193,090 | B1 * | 2/2001 | Connors et al. | 220/4.24 |
| 6,886,703 | B1 | 5/2005 | Bonner | |
| 7,316,319 | B2 | 1/2008 | West | |
| 7,690,506 | B2 * | 4/2010 | Ordonez et al. | 206/408 |

* cited by examiner

*Primary Examiner* — Andrew Perreault
(74) *Attorney, Agent, or Firm* — Crose Law LLC; Bradley D. Crose

(57) ABSTRACT

A system for creating containers configured for variable internal volumes is disclosed. The container is comprised of a removable lid that fits telescopically over the bottom section. The container's storage capacity is adjustable based upon the ability to increase and/or decrease the container's capacity by rotating the container lid prior to placement over the container bottom. The outside walls of the container bottom are comprised of key slot ledges of differing depths. Two opposing inside walls of the container lid are comprised of key ledges configured for engaging the key slot ledges of the container bottom.

17 Claims, 11 Drawing Sheets

VARIABLE HEIGHT ADJUSTABLE STORAGE CAPACITY CONTAINER

CROSS-REFERENCE TO RELATED APPLICATION(S)

This present non-provisional patent application is a continuation-in-part of co-pending U.S. patent application Ser. No. 12/401,596 filed on Mar. 10, 2009, and entitled "VARIABLE HEIGHT ADJUSTABLE STORAGE CAPACITY CONTAINER," and of which the application cited above is incorporated in-full by reference herein.

FIELD OF THE INVENTION

The technology described herein relates generally to adjustable volume containers. In particular, the technology described herein relates to a system, method and devices for providing for storage containers that are configured for varying the internal volume to match the size of the items contained therein.

BACKGROUND OF THE INVENTION

There are a variety of containers and receptacles for long term use such as storage or for temporary use such as for transporting contents. Containers, or boxes, may be made of durable material such as wood, metal, plastic, or composites, or of corrugated fiberboard, paperboard, or other non-durable materials. The size may vary from very small to the size of a large appliance, or even larger. A container may have a horizontal cross section that is square, rectangular, elongated, round or oval; sloped or domed top surfaces, or non-vertical sides.

Currently adjustable volume containers are adjustable via collapsible wall technology, folding wall technology, a threaded screw depth variation technology, and telescoping cylindrical tubes that are adjusted via slotting teeth of one tube into variable length notches of the other tube.

A problem that exists in the container industry, and especially in the bio-storage industry, is the need to have available containers of difference sizes for long term, very low temperature storage of vials that vary in size. For example, four different sized containers would need to be available to store vials that were of different heights. A first container to store vials of height 1, a second container to store vials of height 2, a third container to store vials of height 3, and a fourth container to store vials of height 4. Not only does this require inventory of multiple sized containers, it also can result in containers not being filled to capacity, which leads to storage facilities becoming filled with partially empty containers, necessitating the construction of additional storage facilities.

The need exists for a solution that addresses these problems.

Related patents and published patent applications known in the background art include the following:

U.S. Pat. No. 5,388,714, issued to Zutler on Feb. 14, 1995, discloses a container wherein a top member and a base member are formed as identical units, e.g., from a common mold, and have interactive shapes that permit the top to be laid upon the bottom in a nesting, closed configuration, and rotated relative to the bottom to at least one open configuration with at least three pinpoints of engagement to allow for positive seating of the top member on the bottom in the open configuration and movement of ambient air therebetween. The top cover and base are divided into sections about their circumferential length. The number of sections is determined by the shape of each of the various sections. There can be any number of sections where each section is constructed so as to be able to mate with an exact inverted mirror image of itself. For each first section not so constructed, i.e., that is "irregular" and will not mate with an inverted mirror image of itself, there is a mating second section, whereby the first section on the top member can be matingly engaged with the second section tun the bottom member to effect the closed configuration. Thus, there can be any even number of such paired, mating "irregular" first and second sections. The top and bottom members can be subsequently modified, e.g., decorative or ornamental components can be added to the other, non-interfacing areas. Additionally, a handle could be added to the top cover. A pedestal could be added to the base.

U.S. Pat. No. 2,454,455, issued to Irwin on Nov. 23, 1948 discloses a case adjustable to two lengths, for any purpose for which such adjustment in size may be desirable.

U.S. Pat. No. 7,316,319, issued to West on Jan. 8, 2008, discloses a lift van system that includes: a top and bottom cap, each comprising a folded sheet, wherein each folded sheet has substantially similar design specifications; first and second side wall sections, each comprising a single sheet, wherein the first and second side wall sections have substantially similar design specifications; and a cardboard pallet, wherein the pallet fits into the bottom cap.

U.S. Pat. No. 6,886,703, issued to Bonner on May 3, 2005, discloses a vertically adjustable work bucket apparatus which includes a shell and a container, wherein the container is vertically adjustable within the shell. The shell includes a plurality of furrow series, wherein the furrows series each have a plurality of furrows, along the interior sidewall of the shell. The furrows are provided to receive, house and support corresponding ribs that are affixed to the exterior sidewall of the container. The container is radially rotated so that the ribs are aligned within the furrows to match a desired profile setting, including at least a maximum and minimum profile. The shell includes a plurality of rollers affixed to the bottom of the shell to allow for easy transportation and positioning of the apparatus.

The foregoing patent, published patent application and non-patent information reflect the state of the art of which the inventors are aware and is tendered with a view toward discharging the inventors' acknowledged duty of candor in disclosing information that may be pertinent to the patentability of the technology described herein. It is respectfully stipulated, however, that the foregoing patent and other information do not teach or render obvious, singly or when considered in combination, the inventors' claimed invention.

BRIEF SUMMARY OF THE INVENTION

The technology described herein pertains to a system comprising a container lid portion and container bottom portion configured for varying container volume based on the rotation of the container lid portion prior to placement of the container lid portion on the container bottom portion. The container bottom is configured for receiving contents placed therein. The technology described herein is further comprised of an insert placed (or molded, attached or affixed) on the internal floor of the container bottom potion, where the insert is configured for storage of items placed within the insert, e.g. vials, where the items are separated from each other in an array or other arrangement for easy access. The insert can be configured for storing items of identical dimensions or for non-identical dimensions, e.g., vials of the same diameter, or vials of different diameters.

The technology described herein is a departure from the pre-existing adjustable container patent technologies in that adjustable storage capacity is achieved via rotation of the orientation of the lid relative to the container bottom to create varying storage capacity volumes.

Key slot ledges, e.g. spaces or recesses, configured at various depths are built into the outside walls of a container bottom to enable the lid to perch at different heights above the internal floor of the container, depending upon which orientation of the lid is used when placing the lid telescopically over the container bottom.

In an exemplary embodiment of the technology described herein, a container lid is comprised of four sides, or walls, of equal length with a lid top connecting all four sides. Two key ledges, e.g. protrusions or abutments, are formed on two opposing inside walls with the key ledges on the first wall dimensioned and positioned to be in the same position and length as the key ledges on the second, opposing wall. The remaining two opposing inside walls of the lid top have no key ledges. The width of the key ledges is dimensioned to fit into or on the key slot ledges of the container bottom, depending on the orientation of the container lid to the container bottom.

In the preceding embodiment the ledges and slots are formed to have vertical and horizontal edges, however, other configurations, e.g. the horizontal edges can be corresponding concave and convex edges or convex and concave edges for the container lid ledges and container bottom slot ledges.

An aspect of the technology described herein is to provide an adjustable storage capacity container configured for internal capacity adjustability.

A further aspect of the technology described herein is to provide an adjustable storage container that is easy to use.

A further aspect of the technology described herein is to provide an adjustable storage container of durable construction.

A further aspect of the technology described herein is to provide an adjustable storage container that can be economically manufactured.

A further aspect of the technology described herein is to provide adjustable storage capacity containment for the housing of biological specimens.

Still another aspect of the technology described herein is to provide a variable height biological specimen storage container that enables a user to maximize the use of available biological specimen storage space by adjusting the capacity of the specimen container depending on the space requirements of the biological specimens being housed.

To attain this, the present invention generally comprises a container bottom with key slot ledges of differing depths arranged around the side walls of the container bottom. The telescoping container lid has key ledges built into its side walls to enable it to fit into the key slot ledges of the container bottom. The container lid key ledges are fitted into specific key slot ledges of the container bottom dependent upon which of the various lid orientations is chosen relative to the container bottom. The chosen key slot ledges enable the telescoping lid to perch at a specific height above the internal floor of the container bottom, which results in a chosen storage capacity of the container being attained.

In an exemplary embodiment of the technology described herein, the container lid and top are configured for creating four different internal volumes, depending on the orientation of the container lid when placed on the container bottom, forming a cube-like closed container.

An aspect of the technology described herein is the use of container lid re-orientation to create vertical dimensional variation as selected key slot ledges are engaged or not engaged.

Another aspect of the technology described herein is the creation of different internal storage while maintaining the same "footprint".

Another aspect of the technology described herein is an access panel top configuration to enable access to contents at different settings w/out removing lid.

Another aspect of the technology described herein is a latching or otherwise engaging mechanism for holding a panel top closed while handling the box.

Another aspect of the technology described herein is providing an inner non-contiguous skirt or fully contiguous bladder to provide a membrane or full containerization internally.

Another aspect of the technology described herein is to provide a stabilizing ledge on the off-side from engaged quadrants.

Another aspect of the technology described herein is load bearing considerations, e.g. ledges that engage geometrically based upon product need: rectangular/rounded/triangular.

Another aspect of the technology described herein is in conjunction with varying the height of youth furniture, such as beds/night stands.

Another aspect of the technology described herein is for forming a waste basket that varies in volume as needed.

Another aspect of the technology described herein is the creation of freight train/cargo ship/trucking transport containers.

Another aspect of the technology described herein is closet/drawer space saver storage.

Another aspect of the technology described herein is for forming a toy chest.

Another aspect of the technology described herein is for forming a puzzle or children's toy.

Another aspect of the technology described herein is for use with an internal bladder filled with liquid/granulated materials.

Another aspect of the technology described herein is for adjusting the height of tables/chairs by creating extendable legs.

Another aspect of the technology described herein is in forming a terrarium.

Another aspect of the technology described herein is in forming a hanging vegetable crisper.

Another aspect of the technology described herein is in forming a reusable transport case.

Another aspect of the technology described herein is in forming an adjustable height television stand.

Another aspect of the technology described herein is forming an adjustable height coffee table.

Another aspect of the technology described herein is for forming adjustable internal storage shoe boxes.

BRIEF DESCRIPTION OF THE DRAWINGS

The technology described herein will be better understood by reading the detailed description of the invention with reference to the accompanying drawing figures, in which like reference numerals denote similar structure and refer to like elements throughout, and in which.

DETAILED DESCRIPTION OF THE INVENTION

In describing the preferred and other embodiments of the technology described herein, as illustrated in FIGS. 1-12, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1 through 12, the technology described herein is comprised of a container bottom 2, and a removable container lid 1.

Figure 1:
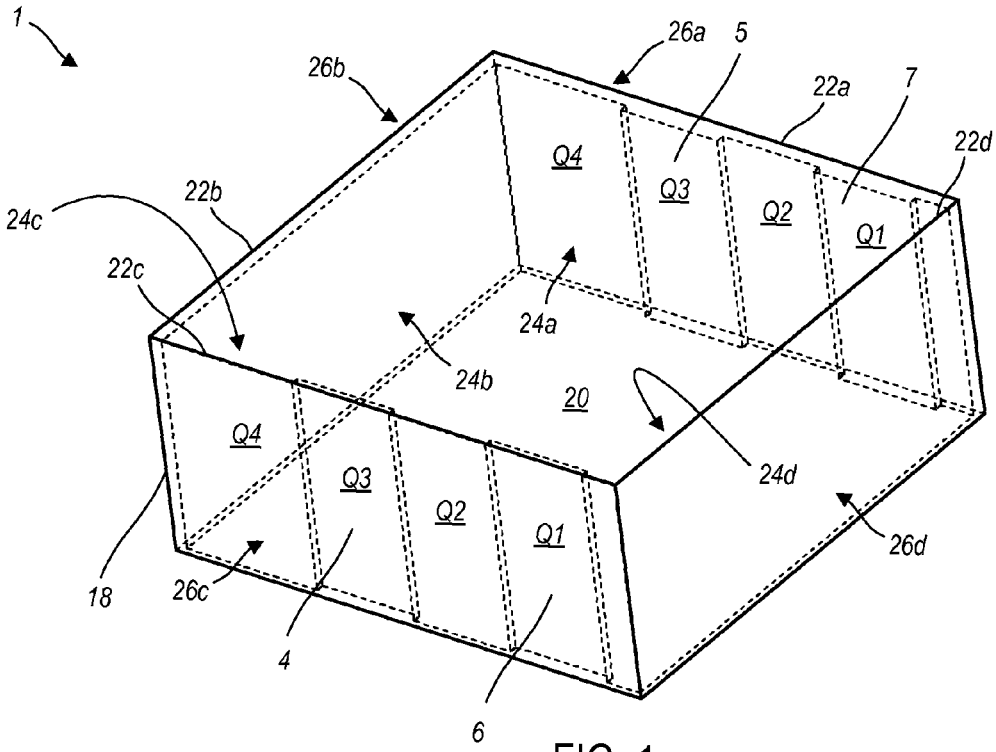
FIG. 1 is a top elevational view of an adjustable container lid according to an embodiment of the technology described herein.
Figure 2:
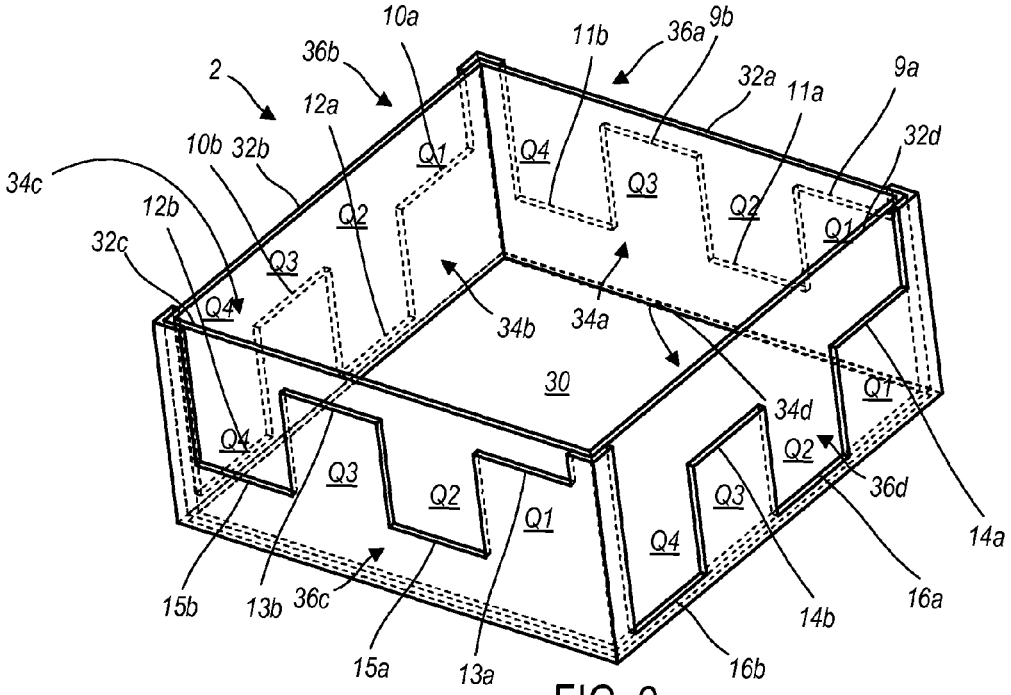
FIG. 2 is a top elevational view of a container bottom with its receptive key slot ledges of differing depths arranged around its outer walls, according to an embodiment of the technology described herein.

The container lid top front corner 3 is illustrated in FIG. 1. The container lid key ledges are disposed on two opposing container lid internal walls 8 of the lid (four internal walls are illustrated in the square geometric design and are referred to as inner wall faces one through four).

Key ledges are formed on the quadrants of inner wall faces one and three of the container lid as illustrated by key ledge 4, in quadrant three of face one and its corresponding key ledge 5, in quadrant three of face three. To achieve balance and stability in the telescoping container lid when placed onto the container bottom, key ledge 6 is also formed on quadrant one of face one, and its corresponding key ledge 7, in quadrant one of face three.

The adjustable container bottom 2 has outer wall key slot ledges formed in each of the quadrants of each container bottom outer wall. Within the square geometric embodiment there are four possible box heights achievable that create four distinct storage capacities. The smallest storage capacity is achieved via placement of the removable container lid 1 in the first lid to bottom orientation so that key ledge 7 and key ledge 5, nest, or fit, into key slot ledges 9, while key ledge 6 and key ledge 4 nest into key slot ledges 13.

The second (incrementally greater) storage capacity is achieved via placement of the lid 1 into the second lid to bottom orientation so that key ledge 7 and key ledge 5 nest into key slot ledges 10 while key ledge 6 and key ledge 4 nest into key slot ledges 14.

The third (further incrementally greater) storage capacity is achieved via placement of the lid 1 into the third lid to bottom orientation where key ledge 7 and key ledge 5 nest into key slot ledges 15 while key ledge 6 and key ledge 4 nest into key slot ledges 11.

The fourth (and greatest volume) storage capacity is achieved via placement of the lid 1 into the fourth lid to bottom orientation whereby key ledge 7 and key ledge 5 nest into key slot ledges 16 while key ledge 6 and key ledge 4 nest into key slot ledges 12.

Figure 3:
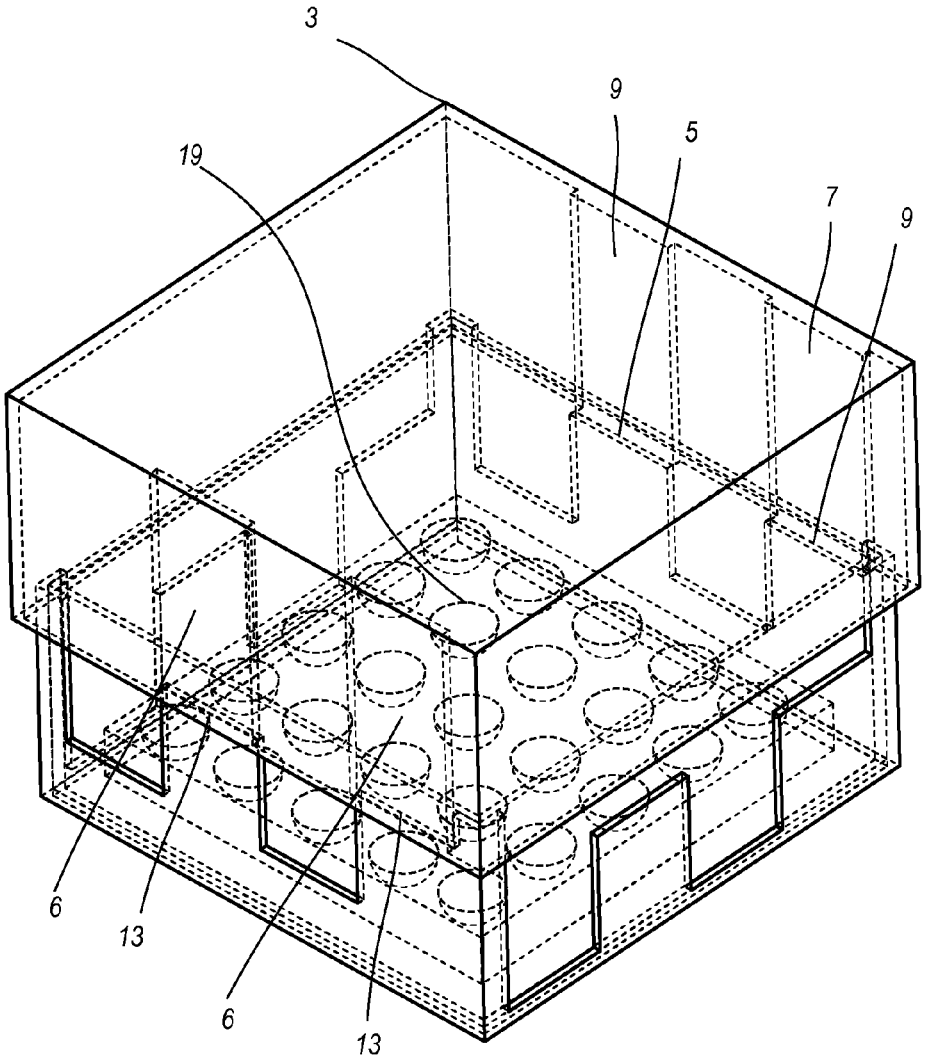
FIG. 3 is an elevational view of the container lid of FIG. 1 telescoping onto the container bottom of FIG. 2 to form a container with the maximum container volume.
Figure 3A:
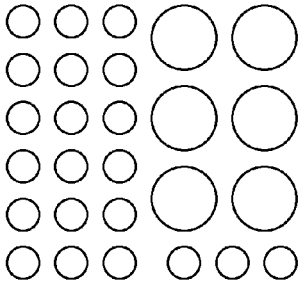
FIG. 3A is a top view illustrating a configuration of the storage grid.
Figure 3B:
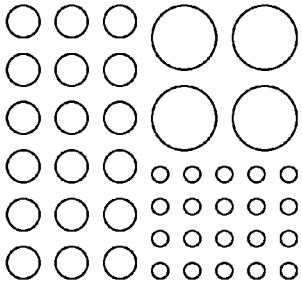
FIG. 3B is a top view illustrating a configuration of the storage grid.
Figure 3C:
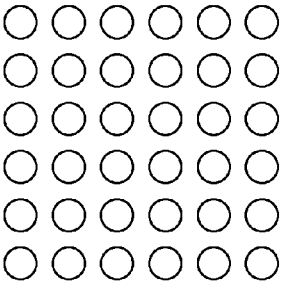
FIG. 3C is a top view illustrating a configuration of the storage grid.
Figure 3D:
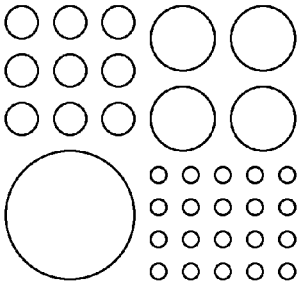
FIG. 3D is a top view illustrating a configuration of the storage grid.
Figure 3E:
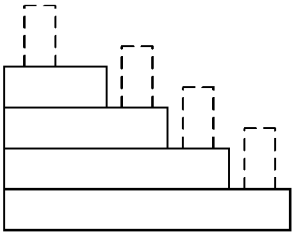
FIG. 3E is a side view illustrating a configuration of the storage grid.
Figure 4:
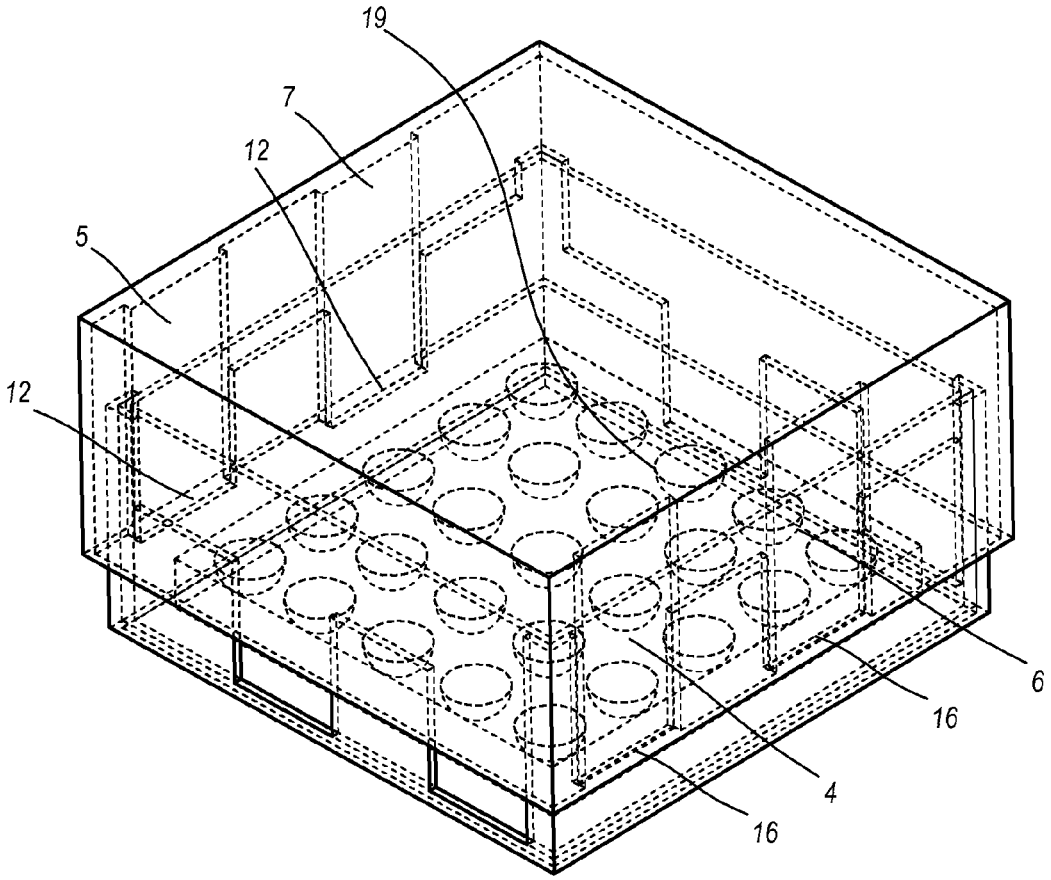
FIG. 4 is an elevational view of the container lid of FIG. 1 rotated 90 degrees clockwise and telescoped down onto the container bottom of FIG. 2 to form a container with the minimum container volume.
Figure 5:
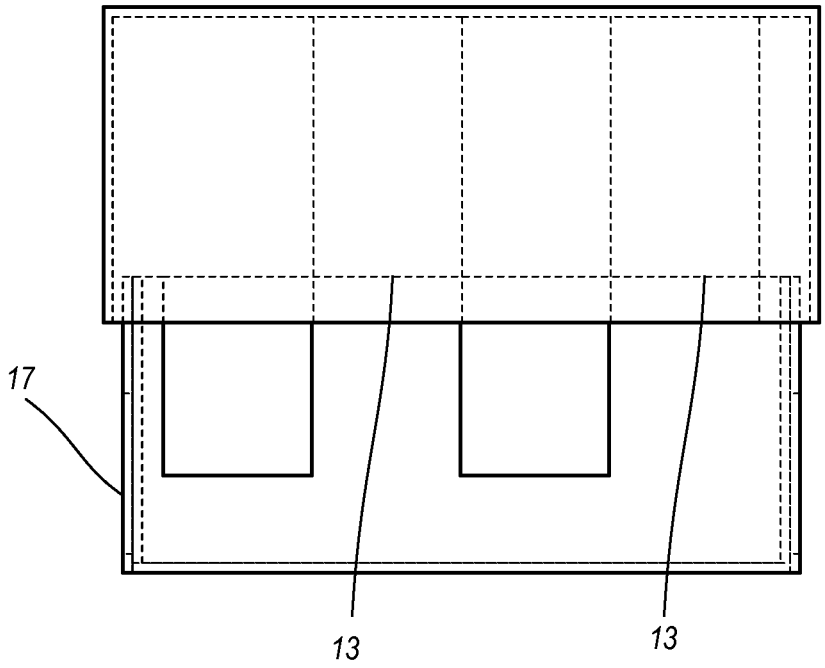
FIG. 5 is a side plan view of FIG. 3.
Figure 6:
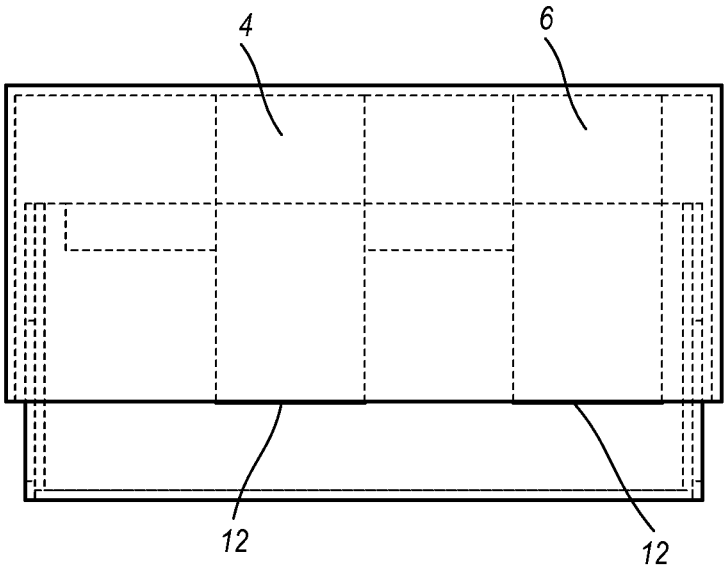
FIG. 6 is a side plan view of FIG. 4.
Figure 7:
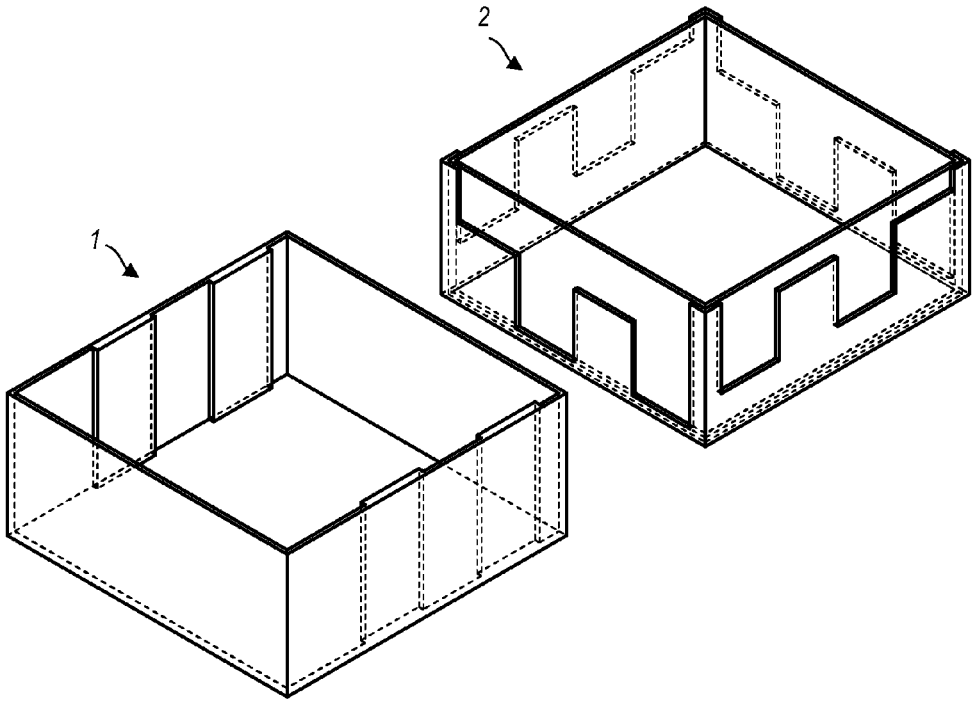
FIG. 7 is an elevational view of the container lid and the container bottom illustrated in FIG. 3, both with the open side face up.
Figure 8:
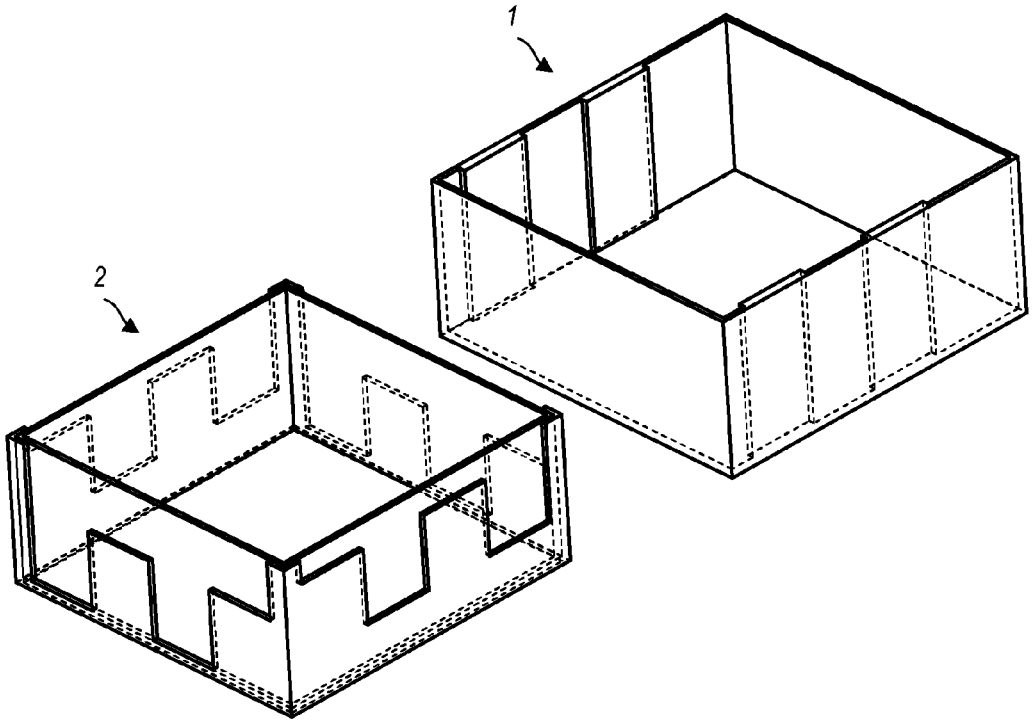
FIG. 8 is an elevational view of the container lid and the container bottom of FIG. 4, both with the open side face up.
Figure 9:
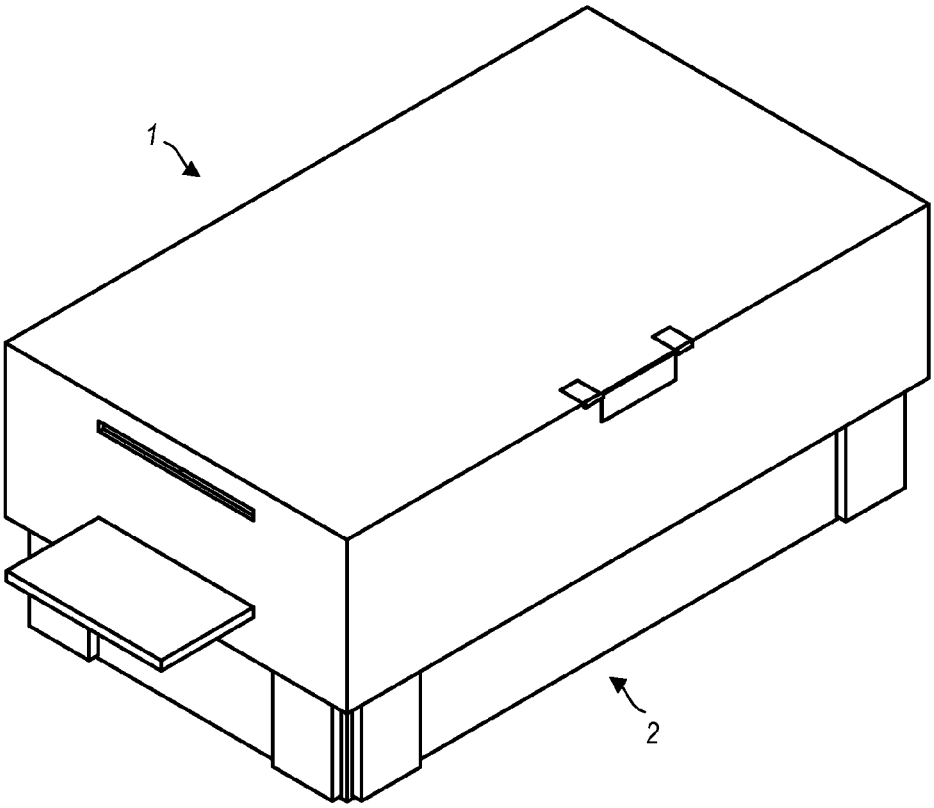
FIG. 9 is an elevational view of a rectangular container lid and bottom illustrating a support member inserted in a first slot to create maximum internal volume, according to an embodiment of the technology described herein.
Figure 10:
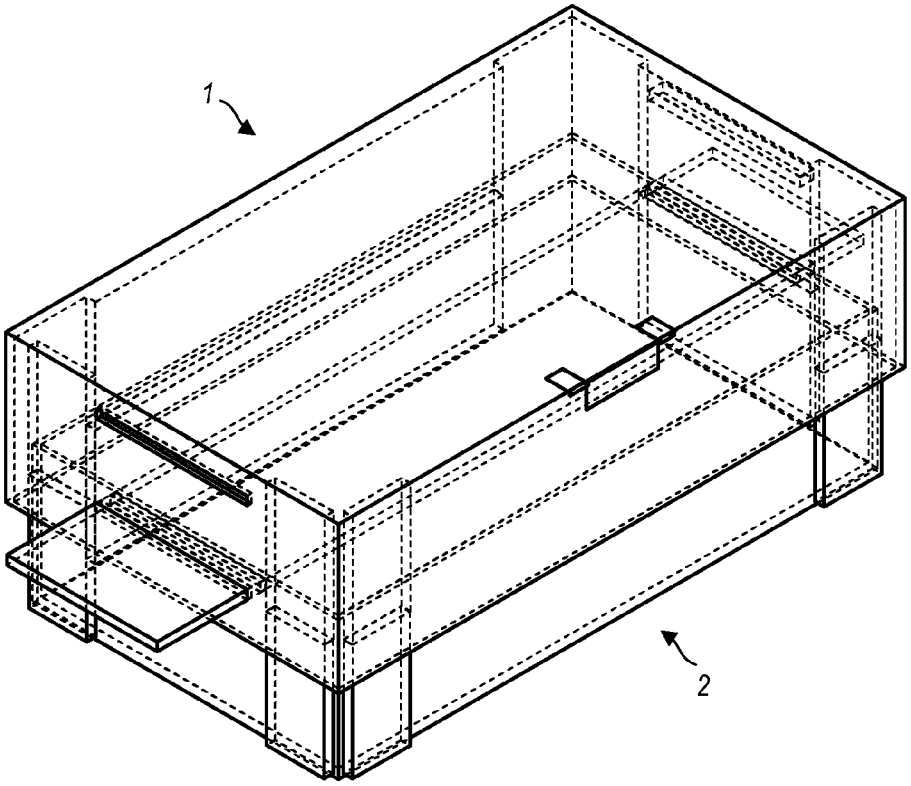
FIG. 10 is an elevational view of FIG. 10, illustrating the internal elements.
Figure 11:
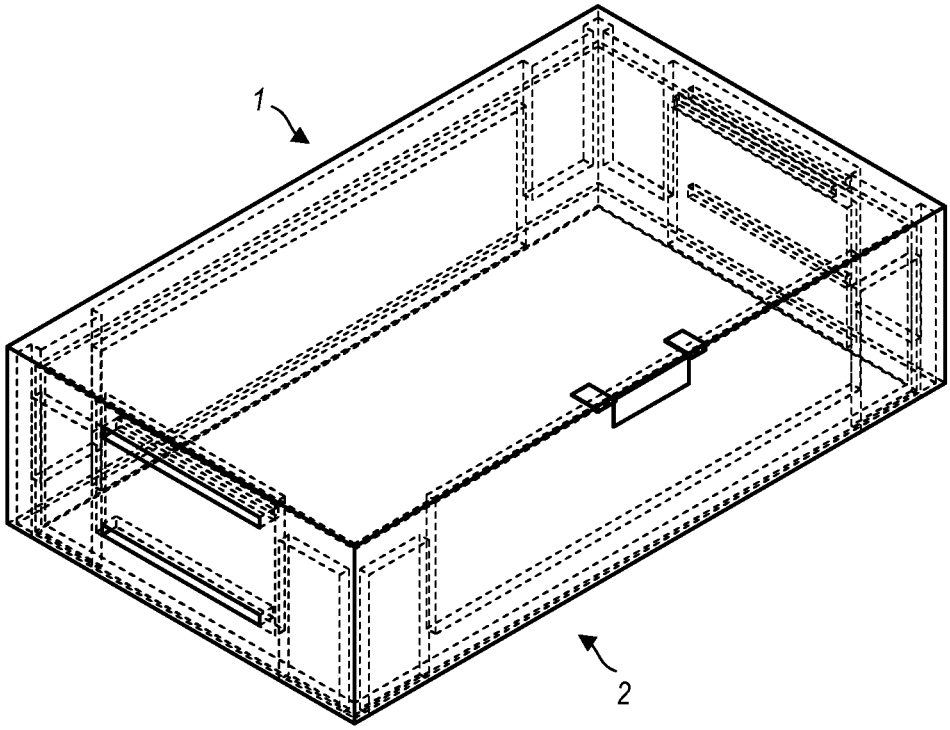
FIG. 11 is an elevational view illustrating a configuration for minimum internal volume.
Figure 12:
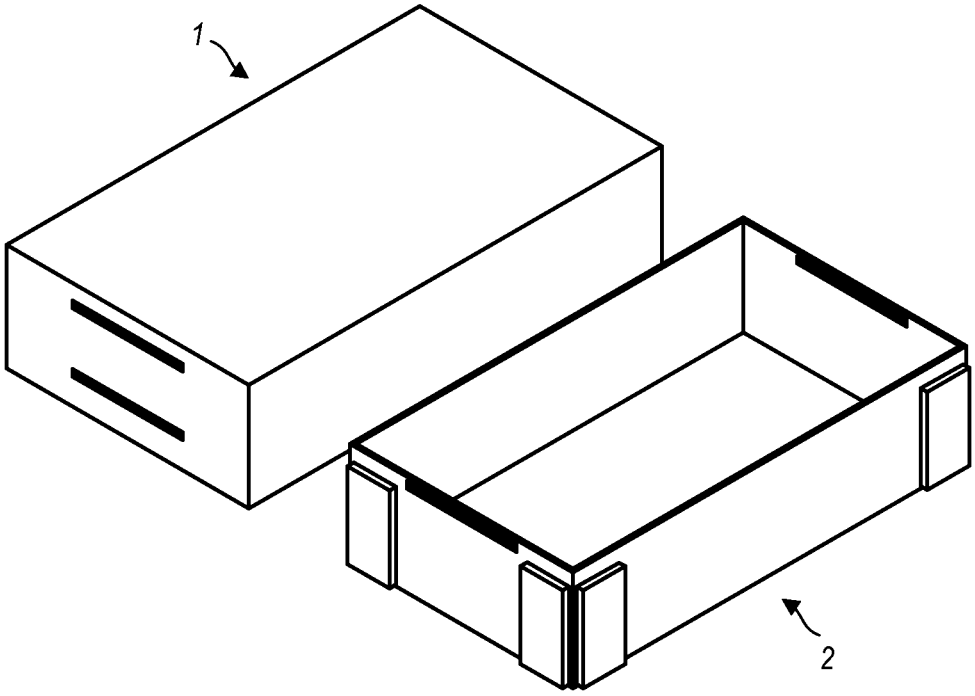
FIG. 12 is an elevational view of FIG. 9, illustrating the container lid and container bottom without the support member.

The container bottom outer wall corners 17 and container lid outer walls are illustrated. A potential application of the adjustable storage capacity container is represented via an internal container bottom storage grid 19, for biological specimen racking, as disclosed in parent application from which this application claims priority, now issued U.S. Pat. No. 8,096,443, and as depicted herein in FIGS. 3 and 4, and with the various configurations as depicted in FIG. 3A having two different dimensions, 3B having three different dimensions, 3C of equal dimensions, and 3D having four different dimensions.

In one embodiment, the technology described herein is comprised of an adjustable storage container comprising:

a. a container lid 1 comprising a top 20 and four walls 22*a*, 22*b*, 22*c*, 22*d* of equal length, i. each wall having an inside lid wall surface, or face, 24*a*, 24*b*, 24*c*, 24*d* and an outside lid wall surface 26*a*, 26*b*, 26*c*, 26*d*, ii. each inside lid wall surface having four quadrants Q1, Q2, Q3, Q4, iii. a first inside lid wall surface 24*c* having a first abutment, or key ledge, 6 disposed on quadrant one Q1 of the first lid inside wall surface 24*c* and having a second abutment 4 disposed on quadrant three Q3 of the first inside lid wall surface 24*c*, iv. a second opposing inside wall 24*a* to the first inside lid wall surface 24*c* having a third abutment 7 disposed on quadrant one Q1 of the second opposing inside wall 24*a* and having a fourth abutment 5 disposed on quadrant three Q3 of the second opposing inside wall 24*a*; and b. a container bottom 2 comprising an internal floor 30 and four walls 32*a*, 32*b*, 32*c*, 32*d* of equal length, i. each container bottom wall 32*a*, 32*b*, 32*c*, 32*d* having an inside bottom wall surface 34*a*, 34*b*, 34*c*, 34*d* and an outside bottom wall surface 36*a*, 36*b*, 36*c*, 36*d*, each outside wall surface having four quadrants Q1, Q2, Q3, Q4, ii. a first outside bottom wall 36*a* surface having 1. a first ledge, or key slot ledge, 9*a* of a first height in quadrant one Q1, 2. a second ledge 11*a* of a second height in quadrant two Q2, 3. a third ledge 9*b* of a first height in quadrant three Q3 and 4. a fourth ledge 11*b* of a second height in quadrant four Q4, iii. a second outside bottom wall surface 36*b* having 1. a fifth ledge 10*a* of a third height in quadrant one Q1, 2. a sixth ledge 12*a* of a fourth height in quadrant two Q2, 3. a seventh ledge 10*b* of a third height in quadrant three Q3 and 4. an eighth ledge 12*b* of a fourth height in quadrant four Q4, iv. a third outside bottom wall surface 36*c* having 1. a ninth ledge 13*a* of the second height in quadrant one Q1, 2. a tenth ledge 15*a* of the first height in quadrant two Q2, 3. an eleventh ledge 13*b* of the second height in quadrant three Q3 and 4. a twelfth ledge 15*b* of the first height in quadrant four Q4, v. a fourth outside bottom wall surface 36*d* having 1. a thirteenth ledge 14*a* of the fourth height in quadrant one Q1, 2. a fourteenth ledge 16*a* of the third height in quadrant two Q2, 3. a fifteenth ledge 14*b* of the fourth height in quadrant three Q3 and 4. a sixteenth ledge 16*b* of the third height in quadrant four Q4.

In this embodiment the storage grid can be dimensioned to fit snugly on the internal floor and can be configured for racking of biological specimen containers, whether of the same or different dimensions, e.g. four different heights, diameters, etc. The storage grid may also be attached, affixed or formed into the internal floor.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the disclosed technology and are intended to be covered in the following claims.

We claim:

1. An adjustable storage container comprising:

a. a container lid comprising a top and four walls of equal length, i. each wall having an inside lid wall surface and an outside lid wall surface, ii. each inside lid wall surface having four quadrants, iii. a first inside lid wall surface having a first abutment disposed on quadrant one of the first lid inside wall surface and having a second abutment disposed on quadrant three of the first inside lid wall surface, iv. a second opposing inside wall to the first inside lid wall surface having a third abutment disposed on quadrant one of the second opposing inside wall and having a fourth abutment disposed on quadrant three of the second opposing inside wall; and b. a container bottom comprising an internal floor and four walls of equal length, i. each container bottom wall having an inside bottom wall surface and an outside bottom wall surface, each outside wall surface having four quadrants, ii. a first outside bottom wall surface having 1. a first ledge of a first height in quadrant one, 2. a second ledge of a second height in quadrant two, 3. a third ledge of a first height in quadrant three and 4. a fourth ledge of a second height in quadrant four, iii. a second outside bottom wall surface having 1. a fifth ledge of a third height in quadrant one, 2. a sixth ledge of a fourth height in quadrant two, 3. a seventh ledge of a third height in quadrant three and 4. an eighth ledge of a fourth height in quadrant four, iv. a third outside bottom wall surface having 1. a ninth ledge of the second height in quadrant one, 2. a tenth ledge of the first height in quadrant two, 3. an eleventh ledge of the second height in quadrant three and 4. a twelfth ledge of the first height in quadrant four, v. a fourth outside bottom wall surface having 1. a thirteenth ledge of the fourth height in quadrant one, 2. a fourteenth ledge of the third height in quadrant two, 3. a fifteenth ledge of the fourth height in quadrant three and 4. A sixteenth ledge of the third height in quadrant four; wherein in combination the first ledge, the second ledge, the third ledge, the fourth ledge, the fifth ledge, the sixth ledge, the seventh ledge, the eighth ledge, the ninth ledge, the tenth ledge, the eleventh ledge, the twelfth ledge, the thirteenth ledge, the fourteenth ledge, the fifteenth ledge, and the sixteenth ledge collectively define sixteen ledges; and a first predefined, user-selectable container height formed collectively from the container lid and the container bottom and defined by a first combination of selected ledges of the sixteen ledges, via rotation of an orientation of the container lid relative to the container bottom;

a second predefined, user-selectable container height formed collectively from the container lid and the container bottom and defined by a second combination of selected ledges of the sixteen ledges, via rotation of an orientation of the container lid relative to the container bottom;

a third predefined, user-selectable container height formed collectively from the container lid and the container bottom and defined by a third combination of selected ledges of the sixteen ledges, via rotation of an orientation of the container lid relative to the container bottom;

a fourth predefined, user-selectable container height formed collectively from the container lid and the container bottom and defined by a fourth combination of selected ledges of the sixteen ledges, via rotation of an orientation of the container lid relative to the container bottom;

a first storage capacity defined within the container lid and the container bottom at the first predefined, user-selectable container height;

a second storage capacity defined within the container lid and the container bottom at the second predefined, user-selectable container height;

a third storage capacity defined within the container lid and the container bottom at the third predefined, user-selectable container height; and a fourth storage capacity defined within the container lid and the container bottom at the fourth predefined, user-selectable container height; wherein the first storage capacity is distinct from the second storage capacity, the first storage capacity is distinct from the third storage capacity, the first storage capacity is distinct from the fourth storage capacity, the second storage capacity is distinct from the third storage capacity, the second storage capacity is distinct from the fourth storage capacity, the third storage capacity is distinct from the fourth storage capacity;

wherein the first, second, third, and fourth predefined, user-selectable container heights are each defined by a combination of selected ledges of the sixteen ledges, via rotation of an orientation of the container lid relative to the container bottom, thereby creating the first, second, third, and fourth distinct storage capacities, one at each of the four predefined, user-selectable container heights.

2. The adjustable storage container of claim 1, further comprising a storage grid dimensioned to fit snugly on the internal floor.

3. The adjustable storage container of claim 2, further comprising a storage grid configured for racking of biological specimen containers.

4. The adjustable storage container of claim 3, wherein the storage grid is configured for racking of biological specimen containers of equal dimensions.

5. The adjustable storage container of claim 3, wherein the storage grid is configured for racking of biological specimen containers having two different dimensions.

6. The adjustable storage container of claim 3, wherein the storage grid is configured for racking of biological specimen containers having three different dimensions.

7. The adjustable storage container of claim 3, wherein the storage grid is configured for racking of biological specimen containers having four different dimensions.

8. The adjustable storage container of claim 1, further comprising a storage grid formed into the internal floor.

9. The adjustable storage container of claim 8, wherein the storage grid is configured for racking of biological specimen containers of equal dimensions.

10. The adjustable storage container of claim 8, wherein the storage grid is configured for racking of biological specimen containers having two different dimensions.

11. The adjustable storage container of claim 8, wherein the storage grid is configured for racking of biological specimen containers having three different dimensions.

12. The adjustable storage container of claim 8, wherein the storage grid is configured for racking of biological specimen containers having four different dimensions.

13. The adjustable storage container of claim 1, further comprising a storage grid attached to the internal floor.

14. The adjustable storage container of claim 13, wherein the storage grid is configured for racking of biological specimen containers of equal dimensions.

15. The adjustable storage container of claim 13, wherein the storage grid is configured for racking of biological specimen containers having two different dimensions.

16. The adjustable storage container of claim 13, wherein the storage grid is configured for racking of biological specimen containers having three different dimensions.

17. The adjustable storage container of claim 13, wherein the storage grid is configured for racking of biological specimen containers having four different dimensions.

* * * * *